US008014695B2

(12) United States Patent
Watanabe

(10) Patent No.: US 8,014,695 B2
(45) Date of Patent: Sep. 6, 2011

(54) IMAGE FORMING APPARATUS

(75) Inventor: Kanehiro Watanabe, Sagamihara (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 516 days.

(21) Appl. No.: 12/127,429

(22) Filed: May 27, 2008

(65) Prior Publication Data

US 2009/0010672 A1 Jan. 8, 2009

(30) Foreign Application Priority Data

Jul. 3, 2007 (JP) ..... 2007-174940

(51) Int. Cl.
*G03G 21/20* (2006.01)

(52) U.S. Cl. ..... 399/92; 399/91; 399/33

(58) Field of Classification Search ..... 399/33, 399/67, 91, 92
See application file for complete search history.

(56) References Cited

U.S. PATENT DOCUMENTS 6,141,512 A * 10/2000 Nagano et al. ..... 399/92
6,173,132 B1 * 1/2001 Kida et al. ..... 399/44

FOREIGN PATENT DOCUMENTS

JP 2004-109732 4/2004
JP 2005-77996 3/2005
JP 2005-338430 12/2005

* cited by examiner

*Primary Examiner* — David M Gray
*Assistant Examiner* — Roy Yi
(74) *Attorney, Agent, or Firm* — Finnegan, Henderson, Farabow, Garrett & Dunner, L.L.P.

(57) ABSTRACT

An image forming apparatus for forming an image on a sheet, includes: an image forming section which forms the image on the sheet; a fixing device which fixes the image onto the sheet; a first duct which covers the fixing device and ventilates air heated by the fixing device; a second duct, which covers the first duct and ventilates cool air introduced from outside; and an exhaust fan which exhausts the air that has passed through each of the first duct and the second duct.

5 Claims, 2 Drawing Sheets

IMAGE FORMING APPARATUS

This application is based on Japanese Patent Application No. 2007-174940 filed on Jul. 3, 2007, which is incorporated hereinto by reference.

BACKGROUND OF THE INVENTION

The present invention relates to an image forming apparatus, which has a fixing apparatus for fixing an image to a sheet.

Generally, in image forming of an electrophotographic system, a toner image is fixed by application of heat and pressure.

Since fixing temperature is usually high temperature of 200° C., an influence of heat generated by a fixing device poses a problem to each part in the image forming apparatus, and various countermeasures have been taken hitherto.

Unexamined Japanese Patent Application Publication No. 2005-77996 discloses a technology that the heat generated by a fixing device is intercepted by using a heat insulation material made from a porous ceramic to housing of the fixing device.

In Unexamined Japanese Patent Application Publication No. 2005-338430, it is proposed that a heat insulation body, which intercepts heat of the fixing device, is structured to be one layer or multiple layer structure.

In Unexamined Japanese Patent Application Publication No. 2004-109732, it is proposed that in order to cool a roller, which conveys a sheet ejected from a fixing device, cool air introduced from outside is put onto the roller.

In an image forming apparatus, which intercepts the heat of the fixing device using the heat insulation material, the heat insulation material is put to the heat for a long time when the fixing device is used for a long period of time. As a result, the heat insulation material deteriorates and its insulation efficiency declines. Also there is a problem that the parts inside the image forming apparatus are influenced by the heat generated by the fixing device.

In addition, although intercepting the heat from the fixing device by the heat insulation device of a sealed structure, in which the air is the heat insulation layer, is also considered, the temperature of the air configuring the heat insulation layer rises and the heat insulation effect declines by prolonged use.

Furthermore, in case when cooling the fixing device by introducing cool air from outside, the cool air spreads inside the fixing device and lowers the temperature of a heating roller, and in order to overcome the reduction in the temperature of the heating roller, electric power is consumed. As a result, a problem with a power dissipation increasing arises.

SUMMARY OF THE INVENTION

The present invention solves such problems, and heat from a fixing device is fully intercepted over a long period of time, and an object of the present invention is to provide an image forming apparatus, which prevents reduction of temperature inside the fixing device.

The above-mentioned object is attained by an aspect of the present invention.

An image forming apparatus for forming an image on a sheet, including:

an image forming section for forming the image on the sheet;

a fixing device for fixing the image onto the sheet;

a first duct, which covers the fixing device, for ventilating air heated by the fixing device;

a second duct, which covers the first duct, for ventilating cool air introduced from outside; and an exhaust fan for exhausting the air, which has passed through each of the first duct and the second duct.

DETAILED DESCRIPTION OF THE PREFERRED EMBODIMENT

In the following, the present invention will be described based on an embodiment of the present invention. However, the present invention is not limited to this embodiment.

Figure 1:
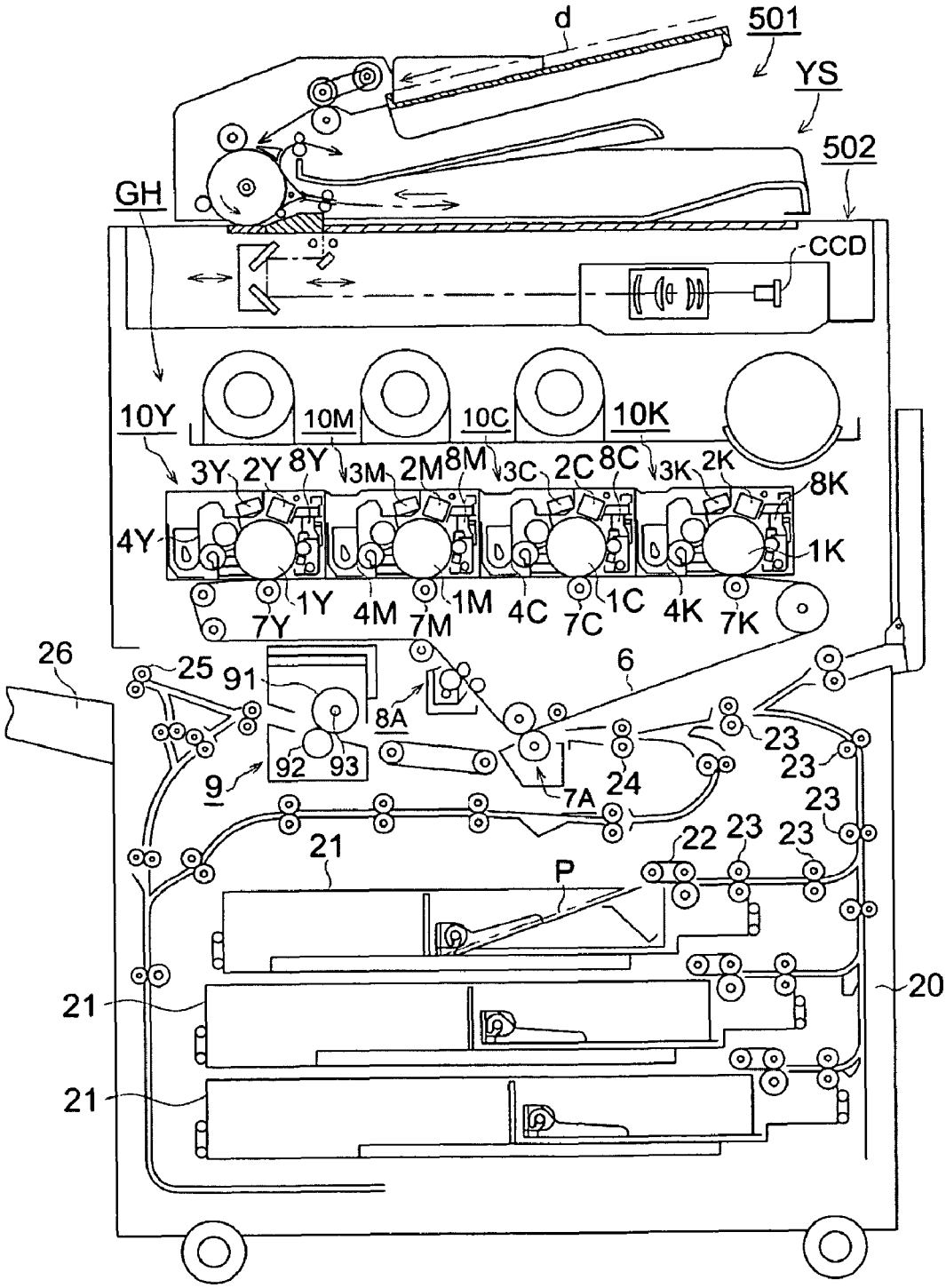
FIG. 1 illustrates an entire configuration of an image forming apparatus pertaining to the present invention.

FIG. 1 illustrates an entire configuration of an image forming apparatus pertaining to the present invention. This image forming apparatus is configured by an image forming section GH, an image reading device YS and a fixing device 9. The image forming section GH is called a tandem type color image forming section. The image forming section GH is configured by a plurality of sets of image forming units 10Y, 10M, 10C and 10K, an intermediate transfer member 6 and a secondary transfer section 7A.

On top of the image forming section GH, the image reading device YS, which is configured by an automatic document feeder 501 and a scanning exposure device 502, is provided. A document "d", which is placed on a document table of the automatic document feeder 501, is conveyed by a conveyance section. And an image on one or both sides of the document is scanned and exposed by an optical system of the scanning exposure device 502 and read into a line image sensor CCD.

In an image-processing section, a signal formed by a photoelectric conversion executed by a line image sensor CCD is sent to exposing sections 3Y, 3M, 3C and 3K after analog processing, an A/D conversion, a shading compensation and image compression processing are performed.

The image forming unit 10Y, which forms the image of a yellow (Y) color, includes a charging section 2Y, an exposing section 3Y, a developing section 4Y, a primary transfer section 7Y and a cleaning section 8Y, which are provided around a drum shaped photoreceptor 1Y. The image forming unit 10M, which forms the image of a magenta (M) color, includes a charging section 2M, an exposing section 3M, a developing section 4M, a primary transfer section 7M and a cleaning section 8M around a drum shaped photoreceptor 1M. The image forming unit 10C, which forms the image of a cyan (C) color, includes a charging section 2C, an exposing section 3C, a developing section 4C, a primary transfer section 7C and a cleaning section 8C around a drum shaped photoreceptor 1C. The image forming unit 10K, which forms the image of a black (Bk) color, includes a charging section 2K, an exposing section 3K, a developing section 4K, a primary transfer section 7K and a cleaning section 8K around a drum shaped photoreceptor 1K. And a latent image forming section is configured by the charging section 2Y and the exposing section 3Y, the charging section 2M and the exposing section 3M, the charging section 2C and the exposing section 3C, and the charging section 2K and the exposing section 3K.

Further, the developing sections 4Y, 4M, 4C and 4K contain two-component developer, which contains a carrier and a small diameter toner of yellow (Y), magenta (M), cyan (C) and black (K).

The intermediate transfer member 6 is wound around a plurality of rollers and rotatably supported. The fixing device 9 includes a fixing roller 93 and a pressure roller 94. The fixing device 9 fixes a toner image on a sheet P by heating and pressurizing in a nip section formed in between the fixing roller 93 and the pressure roller 94.

An image of each color formed by the image forming units 10Y, 10M, 10C and 10K is transferred one after another by the primary transfer sections 7Y, 7M, 7C and 7K onto the rotating intermediate transfer member 6, and the color toner, which the toner image of each color was superimposed, is formed on the intermediate transfer member 6.

A recording sheet P, which is placed in a sheet-feeding tray 21, is separated into each piece of sheet by sheet feeding rollers 22 of a sheet feeding section. Then, the recording sheet P passes through sheet feeding rollers 23 and is fed into a registration roller 24, which is in an idle state. The sheet P is stopped at the registration roller 24. Then, the sheet P is fed into the secondary transfer section 7A with the registration roller 24 starting the rotation at the timing when positions of a leading end of the sheet P and the toner image on the intermediate transfer member 6 correspond. Then, the color toner image is transferred onto the sheet P (secondary transfer). In the fixing device 9, the sheet P onto which the color toner image has transferred is heated and pressurized, and the color toner image on the sheet P is fixed. Then, the sheet P is nipped by sheet ejection rollers 25 and is placed into a sheet ejection tray 26, which is outside of the apparatus.

On the other hand, after the color toner image has been transferred onto the sheet P by the secondary transfer section 7A, a residual toner is removed by an intermediate transfer member cleaning section 8A from the intermediate transfer member 6 that has executed a separation of the sheet P due to a small curvature.

Further, the above was the image forming apparatus, which forms a color image. However, the image forming apparatus may be an image forming apparatus, which forms a monochrome image.

Figure 2:
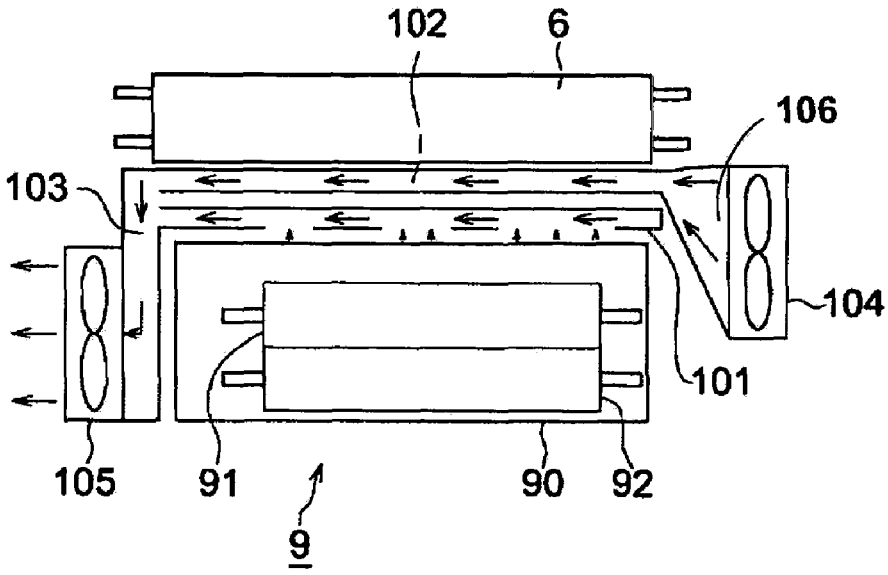
FIG. 2 illustrates a side sectional view of vicinity of a fixing apparatus in an embodiment of the present invention.
Figure 3:
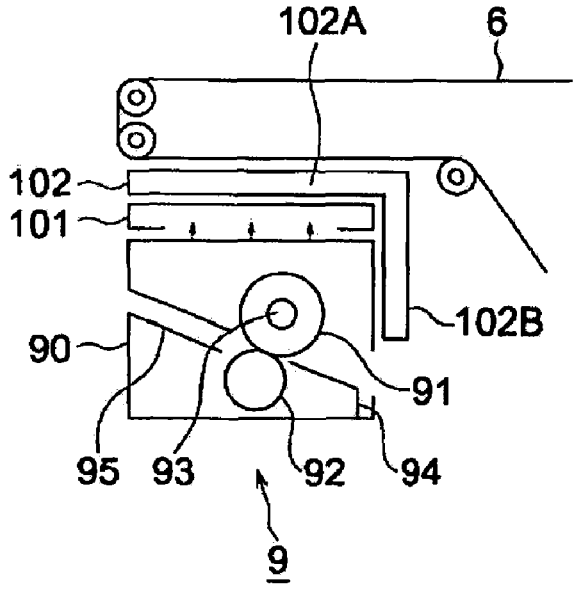
FIG. 3 illustrates a front sectional view vicinity of the fixing apparatus in the embodiment of the present invention.

FIG. 2 illustrates a side sectional view of the vicinity of the fixing device in the embodiment of the present invention. FIG. 3 illustrates a front sectional view of the vicinity of the fixing device in the embodiment of the present invention.

The heat interception of the fixing device 9 illustrated in FIGS. 2 and 3 is executed by the heat insulation section explained in the following to the image forming section, which includes the image forming units 10Y, 10M, 10C and 10K, the intermediate transfer member 6, the secondary transfer section 7A, and the intermediate transfer member cleaning section 8A.

The fixing device 9 includes a heating roller 91, a pressure roller 92, a heater 93, a fixing insertion guide 94 for guiding the sheet P into the fixing device, and the fixing ejection guide 95 for guiding and ejecting the sheet P that passed through the nip between the heating roller 91 and the pressure roller 92.

The fixing device 9 includes a box shaped exterior 90, which is made of a sheet metal or a heat-resistant resin. And many of the above-mentioned parts are provided in the exterior 90. The exterior 90 seals the inside of the fixing device except for a feed port and a sheet ejection port of the sheet P.

The fixing device 9 is provided under the intermediate transfer member 6. The fixing device 9 and the intermediate transfer section 6 are separated by having the heat insulation section between them.

The heat insulation section is configured by a first duct 101, which covers the upper part of the fixing device 9 and is closer to the fixing device, a second duct 102, which covers the upper part of the first duct and is far from the fixing device, and a third duct 103 where the first duct 101 and the second duct 102 flow together.

The first duct 101, as illustrated, includes an opening for introducing air, which is heated by the fixing device 9 and rises as shown by arrows.

In FIG. 2, an external air introduction fan 104 is provided on an external air feed port, namely, a right end of the second duct 102. Further in FIG. 2, an exhaust fan 105 is provided on the exhaust port, namely, a left end of the third duct 103.

The second duct 102, as illustrated in FIG. 3, includes a section 102A, which covers the upper section of the first duct 101 and forms a stratified heat insulation layer with the first duct 101, and a section 102B, which covers a side of the fixing device 9.

The second duct 102 includes an opening or inlet 106 for taking in the air introduced by the external air introduction fan 104.

The arrows in the figures show the flow of the air.

When observing the heat insulation section from the side of the intermediate transfer member 6, the first duct 101 is arranged in a position farther from the intermediate transfer member 6, and the second duct 102 is arranged in a position closer to the intermediate transfer member 6.

The external air introduced by the external air introduction fan 104 passes through the second duct 102. Then, the external air is drawn by the exhaust fan 105 and exhausted out of the image forming apparatus through the third duct 103.

The external air introduction fan 104 is arranged at near side of the image forming apparatus, namely, the outer wall of the apparatus of the side from which an operator operates the image forming apparatus. The exhaust fan 105 is arranged at far side of the image forming apparatus, namely, the outer wall of the apparatus of the opposite side from which an operator operates the image forming apparatus.

Further, the air, which is heated by the fixing device 9 and close to the fixing device, moves to the upper section of the fixing device 9. The air is drawn by the exhaust fan 105 and passes through the first duct 101. Then, the air joins the air from the second duct 102 in the third duct 103 and is exhausted out the image forming apparatus.

Thus, since the fixing device 9 and parts of the image forming apparatus other than fixing device 9 are heat intercepted by the air introduced from outside, even after a prolong use, the insulation efficiency will not decline and the parts inside the image forming apparatus is prevented good from the influence of the heat.

Especially, since the intermediate transfer member 6 arranged in the vicinity of the fixing device 9 is facing the second duct 102 in which the external air ventilates, the influence by the heat from the fixing device 9 is extremely little and it is kept at sufficiently low temperature.

Further, since the intermediate transfer member 6 does not only face the fixing device through the upper section 102A of the second duct 102 in the upper section of the fixing device 9, but the intermediate transfer member 6 also faces the fixing device through the section 102B, which covers the side surface of the fixing device 9 on the side of the fixing device 9, the influence by the heat of the intermediate transfer member 6 can be fully prevented.

In addition, since the fixing device 9 does not directly come in contact with the low temperature air introduced by the first duct 101 from outside, the cooling of the fixing device 9 is prevented.

Therefore, loss of the heat is extremely little, and consumption of the electric power in the fixing device 9 can be suppressed.

What is claimed is:

1. An image forming apparatus for forming an image on a sheet, comprising:

an image forming section which forms the image on the sheet;

a fixing device which fixes the image onto the sheet;

a first duct, which is located between the fixing device and the image forming section so as to cover the fixing device, for ventilating air heated by the fixing device;

a second duct, which is located between the first duct and the image forming section so as to cover the first duct, for ventilating air taken in from an inlet;

an introduction fan, which is located at the inlet, for introducing air from an outside of the image forming apparatus to an inside of the second duct via the inlet; and an exhaust fan, which is located at a downstream side of the inlet in a flow direction of the air introduced by the introduction fan, for exhausting the air that has passed through each of the first duct and the second duct to the outside of the image forming apparatus.

2. The image forming apparatus of claim 1, further comprising:

a third duct provided in a meeting portion at which the first duct and the second duct join each other, wherein the exhaust fan is provided on a rear side of the image forming apparatus and exhausts the air that has passed through the third duct.

3. The image forming apparatus of claim 1, wherein the introduction fan is provided on a front side of the image forming apparatus.

4. The image forming apparatus of claim 1, wherein the second duct covers an upper side of the fixing device and a lateral side of the fixing device that faces the image forming section.

5. The image forming apparatus of claim 1, wherein the second duct keeps out the heat given off from the fixing device by the air introduced by the introduction fan.

* * * * *